United States Patent [19]

Watanabe et al.

[11] 4,194,556

[45] Mar. 25, 1980

[54] COOLING APPARATUS FOR AN INTERNAL COMBUSTION ENGINE

[75] Inventors: Makio Watanabe; Kaneyosi Aoyama; Makoto Shinohara, all of Toyota, Japan

[73] Assignee: Toyota Jidosha Kogyo Kabushiki Kaisha, Toyota, Japan

[21] Appl. No.: 886,359

[22] Filed: Mar. 14, 1978

[30] Foreign Application Priority Data

Jan. 13, 1978 [JP] Japan ..... 53-1858

[51] Int. Cl.[2] ..... F28D 21/00

[52] U.S. Cl. ..... 165/51; 123/41.49; 165/122; 165/135; 181/225; 415/210

[58] Field of Search ..... 123/41.49, 41.48, 41.65, 123/41.66; 165/51, 122, 135, 121; 415/210, 219 R, 119; 181/225, 224

[56] References Cited

U.S. PATENT DOCUMENTS

| | | | |
|---|---|---|---|
| 849,549 | 4/1907 | Lull | 123/41.49 |
| 1,081,023 | 12/1913 | DeFevre et al. | 123/41.49 |
| 1,829,374 | 10/1931 | Saunders | 123/41.49 |
| 3,858,644 | 1/1975 | Beck et al. | 123/41.49 |
| 3,964,568 | 6/1976 | Neumann | 415/119 |

FOREIGN PATENT DOCUMENTS

| | | | |
|---|---|---|---|
| 833162 | 3/1952 | Fed. Rep. of Germany | 123/41.49 |

*Primary Examiner*—Sheldon Richter
*Attorney, Agent, or Firm*—Kenyon & Kenyon

[57] ABSTRACT

Disclosed is a construction of a fan shroud for a fan assembly in an internal combustion engine. The fan shroud operates to direct a flow of air generated by the rotation of the fan so that the flow is effectively passed through the radiator core. The fan shroud has an upper portion which is located above the level of the radiator core. The upper portion has, at the end facing the engine body a cut out portion which operates to decrease the amount of air flow passed through the shroud at a position located above the level of the radiator core. It is thus possible to obtain a fan apparatus of low operational noise, which can operate to generate a sufficient amount of flow of air passed through the radiator core for cooling the engine.

7 Claims, 5 Drawing Figures

COOLING APPARATUS FOR AN INTERNAL COMBUSTION ENGINE

FIELD OF THE INVENTION

The present invention relates to a cooling apparatus for an internal combustion engine, and particularly to a construction of a fan shroud capable of decreasing the noise generated by the operation of the apparatus.

BACKGROUND OF THE INVENTION

Recently, generation of noise from a vehicle provided with an internal combustion engine has been legally restricted in that the noise level is to be suppressed below a predetermined limit. The noise is partly caused by the operation of the cooling fan apparatus of the engine. The noise level generated from the fan corresponds to the rotational speed of the fan, while the speed of the fan corresponds to the cooling effect by a radiator core of the engine. Therefore, the rotational speed of the fan apparatus, in other words, the amount of air to be passed through the radiator core should be determined so that the noise is kept below a predetermined maximum level while the engine is effectively cooled.

In a conventional internal combustion engine, a fan shroud of tubular shape covering the fan assembly is arranged to face the radiator core for guiding the flow of air so that the flow is effectively passed through the radiator core. From the point of view of obtaining the maximum effect of the fan shroud, a fan shroud of a diameter conforming to the height of the radiator core should be used. However, parts for forming the engine and the vehicle body are made as module elements of standard size. Therefore, in a particular design of an engine or engine body, the fan shroud is often situated so that upper portion thereof is located above the level of the radiator core.

SUMMARY OF THE INVENTION

An object of the present invention is, in the particular design of engine wherein the upper portion of the fan shroud is located above the level of the radiator core, to provide a construction of a fan shroud of low operational noise while keeping the engine effectively cooled.

According to the present invention a cooling apparatus for an internal combustion engine is provided, which comprises: a fan assembly driven by the crank shaft of the engine, the fan assembly including a plurality of fan blades; a radiator core arranged on a side of the fan blades remote from the engine body, and; a fan shroud of tubular shape extending from one side of the radiator core toward the engine body, which forms, at the end thereof facing the engine body, a cut-out portion. The cut-out portion causes a small amount of air to be passed through the shroud at a position located above the level of the upper end of the radiator core while the amount of air passed through the radiator core is prevented from being substantially decreased. Therefore, an apparatus of low operational noise is obtained while a sufficient amount of air is passed through the radiator core for effectively cooling the engine.

DESCRIPTION OF PREFERRED EMBODIMENTS

Figure 1:
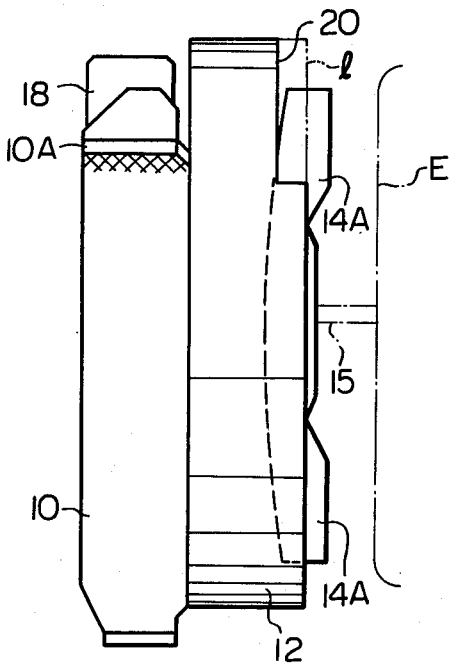
FIG. 1 is a side view of a cooling apparatus according to the present invention.
Figure 2:
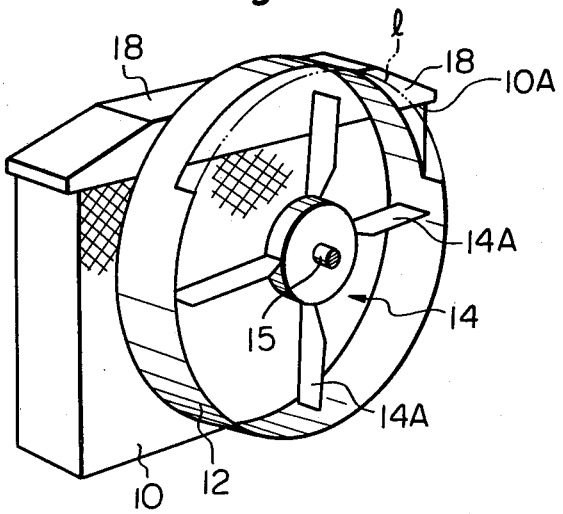
FIG. 2 is a schematically perspective view of the apparatus in FIG. 1.

Referring to FIGS. 1 and 2, numeral 14 designates a fan assembly having a drive axis 15 connected to a crankshaft of an engine body which is shown by a phantom line E. The fan assembly has fan blades 14A. A radiator core 10 is arranged on the side of the fan blades 14A remote from the engine body E. A water tank 18 is mounted on the upper end 10A of the radiator core 10, which tank 18 is connected to a cooling jacket (not shown) in the engine body E. A fan shroud 12 operates to direct the flow of air generated by the rotation of the fan assembly 14 so that the flow is effectively passed through the radiator core. The fan shroud 12 extends from one side of the radiator core 10 toward the engine body E so that the fan blades 14A are substantially covered by the shroud 12. The fan blades 14A have a standard size of 320 mm$\phi$. The diameter of the fan shroud 12 is 380 mm. Due to the standard size of the fan blades, the height of the radiator core 10 does not conform to that of the fan shroud 12 so that the upper portion of the fan shroud 12 projects above the level of the upper end 10A of the radiator core 10.

According to the present invention, the above-mentioned upper portion of the fan shroud 12 has, at the side facing the engine body E, a cut out portion 20 of arc shape, which does not substantially cover the fan blades 14A. According to this embodiment the axial and circumferential length of the cut-out portion are 20 mm and 400 mm, respectively.

It should be noted that the prior art fan shroud does not have such a cut-out portion and has a straight end as shown by a phantom line.

Due to the cut-out portion 20, a small amount of air can pass through the fan shroud 12 during the rotation of the fan blades 14A. This, in turn, causes a low operational noise to be generated from the fan assembly. However, a sufficient amount of air can pass through the radiator core 10 to effectively cool the engine cooling water, since the cut-out portion 20 is located above the level of the upper end of the radiator core 10.

Figure 3:
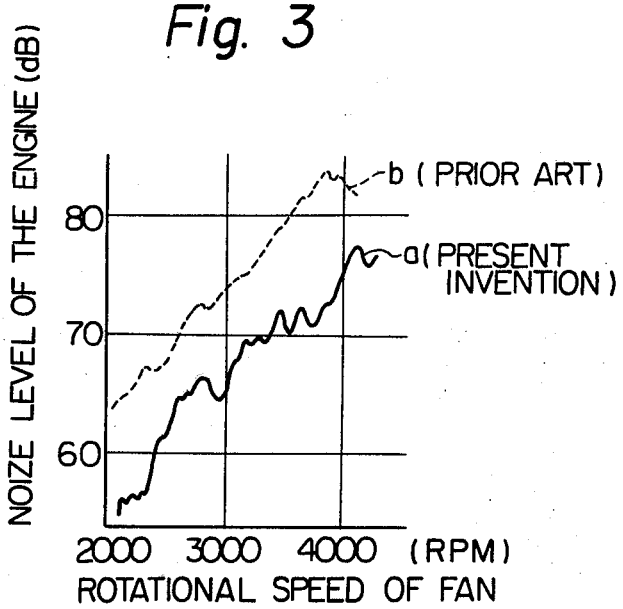
FIG. 3 is a graph showing relations between noise generated from the engine and rotational speed of the engine.

In FIG. 3, the curve a indicates a relationship between the rotational speed of the engine and the level of operational noise when a fan shroud of the present invention is used, while the curve 6 indicates a similar relationship when the prior art fan shroud is used. As will be clear from these curves, the operational noise of the cooling apparatus can be effectively decreased by the fan shroud of the present invention.

It should be noted that, according to tests conducted by the applicants with regard to the cooling effect of the engine, it was found that the cooling of the engine is not adversely effected by the fan shroud forming the cut-out portion 20.

Figure 4A:
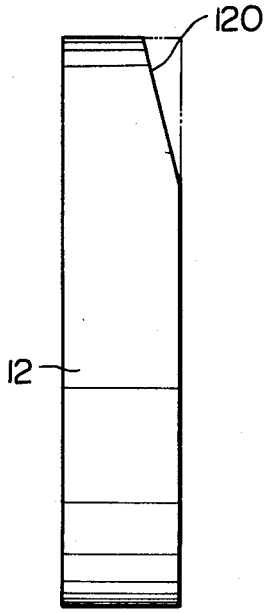
FIGS. 4A and 4B show modifications of the present invention.
Figure 4B:
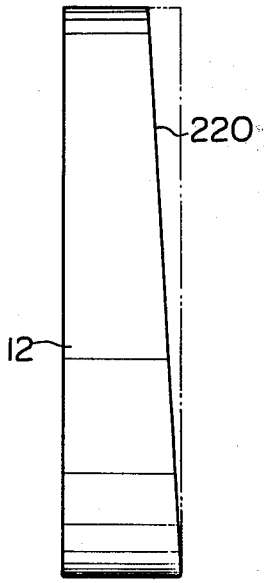

Many modification can be made with regard to the shape of the fan shroud within the scope of the present invention. In the modifications shown in FIGS. 4A and 4B, the fan shroud 12 has a cut-out portion 120 or 220 of different shape.

What is claimed is:

1. A reduced-noise cooling apparatus for an internal combustion engine, said apparatus including a radiator core, a coolant tank mounted on the upper end of the core, a multi-bladed fan assembly mounted adjacent to one side of the core for rotation such that the upper part of the path described by the tips of the fan blades is above the level of the upper end of the radiator core, and a tubular shroud extending from said one side of the radiator core and the coolant tank coaxially with and circumferentially surrounding the fan assembly, wherein the improvement comprises:

said shroud having an axial length which is less for the portion of the shroud which is above the level of the upper end of the radiator core than for the remainder of the shroud, whereby the amount of air passed through the shroud per unit area above the level of the upper end of the radiator core is less than the amount of air passed per unit area through the remainder of the shroud.

2. A reduced-noise cooling apparatus according to claim 1 wherein the shroud has a constant first axial length for at least a portion of its circumference above the level of the upper end of the radiator core and a constant second axial length for the remainder of its circumference, the first axial length being substantially shorter than the second axial length.

3. A reduced-noise cooling apparatus according to claim 2 wherein the difference between said second and first axial lengths is equal to approximately five percent of the diameter of the shroud.

4. A reduced-noise cooling apparatus according to claim 2 wherein the upper portion of said shroud having said first axial length comprises approximately one-third of the total circumference of the shroud.

5. A reduced-noise cooling apparatus according to claim 2 wherein said first axial length approximately corresponds to the axial clearance between the blades of the fan assembly and radiator core and coolant tank such that the portion of the shroud having said first axial length does not substantially cover the fan blades.

6. A reduced noise apparatus according to claim 1 wherein the axial length of the portion of the shroud above the level of the upper end of the radiator core decreases progressively to a minimum at the top of the shroud.

7. A reduced-noise cooling apparatus according to claim 1 wherein the axial length of the shroud decreases progressively from the bottom to the top of the shroud.

* * * * *